US010839721B2

(12) United States Patent
Smith et al.

(10) Patent No.: US 10,839,721 B2
(45) Date of Patent: Nov. 17, 2020

(54) DEVICE FOR USE IN HANGING SHEET MATERIAL

(71) Applicant: Polyplas International Pty Ltd., Rowville (AU)

(72) Inventors: Tinus Smith, Rowville (AU); Peter Luscombe, Rowville (AU); John Van Vuuren, Rowville (AU); James Renshaw, Rowville (AU)

(73) Assignee: POLYPLAS INTERNATIONAL PTY LTD., Rowville (AU)

( * ) Notice: Subject to any disclaimer, the term of this patent is extended or adjusted under 35 U.S.C. 154(b) by 0 days.

(21) Appl. No.: 16/458,235

(22) Filed: Jul. 1, 2019

(65) Prior Publication Data

US 2020/0005684 A1 Jan. 2, 2020

(30) Foreign Application Priority Data

Jul. 2, 2018 (AU) ..... 2018902395
Nov. 2, 2018 (AU) ..... 2018904174

(51) Int. Cl.
*G09F 7/18* (2006.01)

(52) U.S. Cl.
CPC ..... *G09F 7/18* (2013.01); *G09F 2007/186* (2013.01)

(58) Field of Classification Search
CPC ..... G09F 7/18; G09F 2007/186
See application file for complete search history.

(56) References Cited

U.S. PATENT DOCUMENTS 5,381,991 A * 1/1995 Stocker ..... G09F 7/18 248/206.5
5,409,191 A * 4/1995 Wenmaekers ..... E04B 9/006 248/317
5,499,789 A * 3/1996 Rose ..... A47F 5/0892 248/317
7,712,239 B2 * 5/2010 Pitcher ..... G09F 7/18 248/343
2009/0056187 A1 * 3/2009 Pitcher ..... G09F 7/22 40/617
2011/0099866 A1 * 5/2011 Pitcher ..... G09F 7/20 40/611.01
2012/0000106 A1 * 1/2012 Wick ..... G09F 7/18 40/606.01
2013/0126809 A1 * 5/2013 Britten ..... B66D 1/00 254/385
2013/0145662 A1 * 6/2013 Clark ..... G09F 7/18 40/617

(Continued)

*Primary Examiner* — Gary C Hoge
(74) *Attorney, Agent, or Firm* — EcoTech Law Group, P.C.

(57) ABSTRACT

A device for use in hanging sheet material is described. The device includes a body member, a catch member, and a hook. The body member has a crown portion, and pair of spaced apart legs that extend from the crown portion and define a slot there between. The slot opening at a bottom end such that the body member may locate on an edge of the sheet material with a portion of sheet material positioned within the slot. The catch member is movable between an engaged position in which the catch member resists removal of sheet material that is positioned within the slot thereby retaining the sheet material to the body member, and a retracted position in which sheet material is removable from the slot. The hook includes a bight portion, a shank portion and a point end.

20 Claims, 18 Drawing Sheets

(56) References Cited

U.S. PATENT DOCUMENTS

| | | | | |
|---|---|---|---|---|
| 2013/0291415 | A1* | 11/2013 | Stein | A47G 1/1686 40/601 |
| 2014/0345176 | A1* | 11/2014 | Okert | G09F 7/22 40/606.03 |
| 2015/0262516 | A1* | 9/2015 | White | G09F 7/18 40/600 |
| 2015/0305519 | A1* | 10/2015 | Brahar | G09F 7/18 29/428 |
| 2017/0053569 | A1* | 2/2017 | Votolato | G09F 27/00 |

* cited by examiner

DEVICE FOR USE IN HANGING SHEET MATERIAL

RELATED APPLICATIONS

This patent application claims priority to Australian Patent Application No. 2018902395 filed on Jul. 2, 2018 and to Australian Patent Application No. 2018904174 filed on Nov. 2, 2018, both of which are incorporated by reference, in their entirety, for all purposes.

FIELD

The present invention relates to a device for use in hanging sheet material.

BACKGROUND

Sheet material, such as paper and plastic, is often used for advertising goods at a point of sale or supply, and/or for providing information relating to services, directions, locations, and the like. Typically, information regarding the goods to be advertised is printed onto the sheet material, which is then cut to the desired display size. The printed sheet (also known as a "poster" or "sign") is then displayed in a desired location.

In some instances, it is desirable to display nearby to the actual goods that are advertised on the sign, but also not in a location that will inhibit movement of foot traffic. For example, within a supermarket it may be desirable to advertise to shoppers moving along aisles. In this example, one option is to hang the sign from the ceiling and above the aisle, as this does not impede movement of shoppers along the aisle and/or access to produce on shelves. Similarly, within a supermarket it may be desirable to advertise to shoppers at a display fridge, for example at a butcher or delicatessen section of the supermarket. In this example, one option is to hang the sign from the ceiling over the service area behind the display fridge, as this does not impede the movement of staff within the service area.

In the above examples, it is desirable for signs to be removed and replaced with an alternative sign quickly and simply for a variety of reasons.

There is a need to address the above, and/or at least provide a useful alternative.

SUMMARY

There is provided a device for use in hanging sheet material, the device comprising:

a body member having a crown portion, and pair of spaced apart legs that extend from the crown portion and define a slot there between, the slot opening at a bottom end such that the body member may locate on an edge of the sheet material with a portion of sheet material positioned within the slot;

a catch member that is movable between an engaged position in which the catch member resists removal of sheet material that is positioned within the slot thereby retaining the sheet material to the body member, and a retracted position in which sheet material is removable from the slot; and a hook that includes a bight portion, a shank portion that is attached at a lower end to the body member and at an upper end to one side of the bight portion, and a point end that is spaced from the shank portion by the bight portion at the opposing second side of the bight portion, wherein the hook defines an access gap between the shank portion and the point end through which to pass an article to thereby locate the article within the bight portion so as hang the device from the article.

In at least some embodiments, the slot narrows in a direction towards the crown portion.

In some embodiments, the crown portion includes a channel defining a secondary slot that opens onto the slot defined between the legs, wherein the width of the secondary slot is narrower than that of the slot.

Preferably, the secondary slot is located centrally between the legs. Alternatively, the secondary slot may be offset with respect to the legs. In some such embodiments, the lateral side of the secondary slot may align with the lateral side of the slot defined between the legs.

In certain embodiments, at least one of the outer edges that are between the slot and the secondary slot are curved. Alternatively or additionally, at least one of the outer edges that are between the slot and the secondary slot are convex.

Preferably, the hook is oriented with respect to the body member such that the direction of movement of the catch member between the engaged and retracted positions is parallel with a plane defined by the bight portion of the hook. The device may be configured with the hook oriented with respect to the body member such that the direction of movement of the catch member from the retracted position towards the engaged position is the same as the direction from the shank portion towards the point end.

In at least some embodiments, the catch member is in the form of a pin, and a first one of the legs has a through hole, whereby the pin extends through the through hole and projects transversely with respect to the slot when in the engaged position. In some embodiments, the pin is partially withdrawn from the slot when in the retracted position. In some alternative embodiments, the pin is completely withdrawn from the slot when in the retracted position.

The second leg may include a hole that is axially aligned with the through hole in the first leg, whereby when the pin is in the engaged position, the pin extends into the hole in the second leg.

In some embodiments, the hole in the second leg is a through hole, such that when the pin is in the engaged position, the pin extends through both through holes. In some alternative embodiments, the hole in the second leg is a blind hole, such that when the pin is in the engaged position the leading end of the pin is located within the blind hole.

In certain embodiments, the pin has at least one radial projection and the body member has at least one complementary engagement feature, and the projection and complementary engagement feature are configured to interengage when the pin is in the engaged position. The radial projection may be external thread, and the complementary engagement feature may be internal thread formed on at least one of the holes in the first and second legs. In embodiments in which the pin has external thread, the pin preferably has a head that is configured to facilitate rotation of the pin.

In some embodiments, the pin and body member are configured so that the pin is retained within the body member in the retracted position.

The body member may include a housing that projects from the first leg, the housing having an internal bore that aligns with the through hole in the first leg, wherein the pin extends through the internal bore when in the engaged position. The housing may include an annular flange that is spaced from the first leg.

The pin may include a leading portion and a trailing portion, the leading portion being closer to the second leg than the trailing portion, and wherein the outer diameter of the trailing portion is less than the outer diameter of the leading portion. Preferably, the device has a clearance fit between the inner diameter of the annular flange and the outer diameter of the trailing portion. More preferably, the inner diameter of the annular flange is less than the outer diameter of the leading portion.

In some embodiments, the device comprises a spring that biases the pin towards the engaged position. In some alternative embodiments, the device comprises a spring that provides a bias to urge the pin away from the retracted position. The spring may be a coil spring that extends around the pin. More preferably, the spring extends around the trailing portion of the pin. In at least some embodiments, the inner diameter of the annular flange is less than the outer diameter of the spring, such that at least a portion of the spring is captured within the housing.

Preferably, a section of the leading portion that is remote from the trailing portion tapers in a direction away from the trailing portion.

In some embodiments, the leading portion is dimensioned such that when the pin is in the engaged position, one part of the leading portion is located within the hole in the second leg, and another part of the leading portion is located within the through hole in the first leg. Alternatively or additionally, the leading portion is dimensioned such that when the pin is in the engaged position, one part of the leading portion is located within the hole in the second leg, and another part of the leading portion is located within the internal bore of the housing.

Part of the trailing portion may project outwardly from the housing when the pin is in the engaged position.

The pin may include a clasping feature that facilitates a user moving the pin from the engaged position to the retracted position. In one example, the clasping feature is a ring that is connected to the trailing portion.

The pin may be formed with a leading portion that includes an external thread, the leading portion being spaced from the pin head by a trailing portion with a smooth cylindrical outer surface. Preferably, the major diameter of the external thread is greater than the diameter of the trailing portion. Preferably, the spring extends around the unthreaded portion of the pin. More preferably, the major diameter of the external thread is greater than the internal diameter of the coil spring. In such embodiments, the hole in the second leg has an internal thread. Preferably, the through hole in the first leg is unthreaded. In such embodiments, the length of the leading portion may be equal to, or less than, the depth of the hole in the second leg.

There is also provided a device for use in hanging a piece of sheet material, the device comprising:

a body member having a backing surface;

one or more catch pins that each include an inner portion that is connected to the body member and projects perpendicularly outwardly from the backing surface, and at least one of the catch pins includes an outer portion that is spaced from the backing surface by the inner portion, each outer portion including a contact surface that extends generally transversely to the inner portion and faces towards the backing surface, whereby in use of the device each of the catch pins is passed through an aperture in the piece of sheet material to then capture the piece of sheet material between the backing surface and the contact surfaces of the catch pins; and a hook that includes a bight portion, a shank portion that is attached at a lower end to the body member and at an upper end to one side of the bight portion, and a point end that is spaced from the shank portion by the bight portion at the opposing second side of the bight portion, wherein the hook defines an access gap between the shank portion and the point end through which to pass an article to thereby locate the article within the bight portion so as hang the device from the article.

In some embodiments, the catch pins are resiliently deflectable from a neutral position. In some alternative embodiments, the catch pins are substantially rigid.

In some embodiments, each outer portion is configured such that contact surface extends in two or more directions transversely with respect to the respective inner portion. Preferably, each outer portion is configured such that the contact surface is annular and generally radial with respect to the respective inner portion.

In at least some embodiments, the hook is oriented with respect to the body member such that the direction across the bight portion and away from the shank portion is generally perpendicular to the planar direction of sheet material located within the slot.

Preferably, the bight portion is generally arcuate. In some embodiments the bight portion has a substantially constant radius. The bight portion may be configured such that the radial centre of the bight portion is positioned on or between the bight portion and a chord line that extends between opposing ends of the bight portion.

The shank portion of the hook may include one or more bends in an opposing direction to that of the bight portion. The shank portion may additionally include one or more bends in the same direction as that of the bight portion.

Preferably, the hook is configured such that the minimum width of the hook between the access gap and the deepest portion of the bight portion is less than the length of the chord line that extends between opposing ends of the bight portion.

The hook may include an end portion that extends between the bight portion and the point end of the hook. In some embodiments, the end portion may include one or more bends in an opposing direction to that of the bight portion.

Preferably, the hook is oriented with respect to the body member such that the direction of movement of the catch pin between the engaged and retracted positions is parallel with a plane defined by the bight portion of the hook. The device may be configured with the hook oriented with respect to the body member such that the direction of movement of the catch pin from the retracted position towards the engaged position is the same as the direction from the shank portion towards the point end.

The device may further comprise a gate that is movably attached to the shank portion, and wherein the gate is operable to abut the hook adjacent the point end to form a closed loop that includes the bight portion.

There is also provided a system for hanging a piece of sheet material, the system comprising:

a plurality of droppers that each have a tensile member, and an upper end connector for use in connecting the upper end of the respective tensile member to a soffit or soffit-like structure, the tensile member having a lower end;

a rail that is secured to the lower ends of the tensile members so as to be suspended beneath the soffit or soffit-like structure; and a plurality of devices for use in hanging sheet material as previously described, wherein the piece of sheet material may be retained to the body members of the devices, and the hooks of the devices are hooked onto the rail such that the rail is located within the bight portions of the devices to thereby hang the piece of sheet material.

Each dropper may include a lower end connector at the lower end of the tensile member for connecting the lower end of the respective tensile member to the rail.

BRIEF DESCRIPTION OF THE DRAWINGS

In order that the invention may be more easily understood, an embodiment will now be described, by way of example only, with reference to the accompanying drawings, in which.

DETAILED DESCRIPTION

Figure 1:
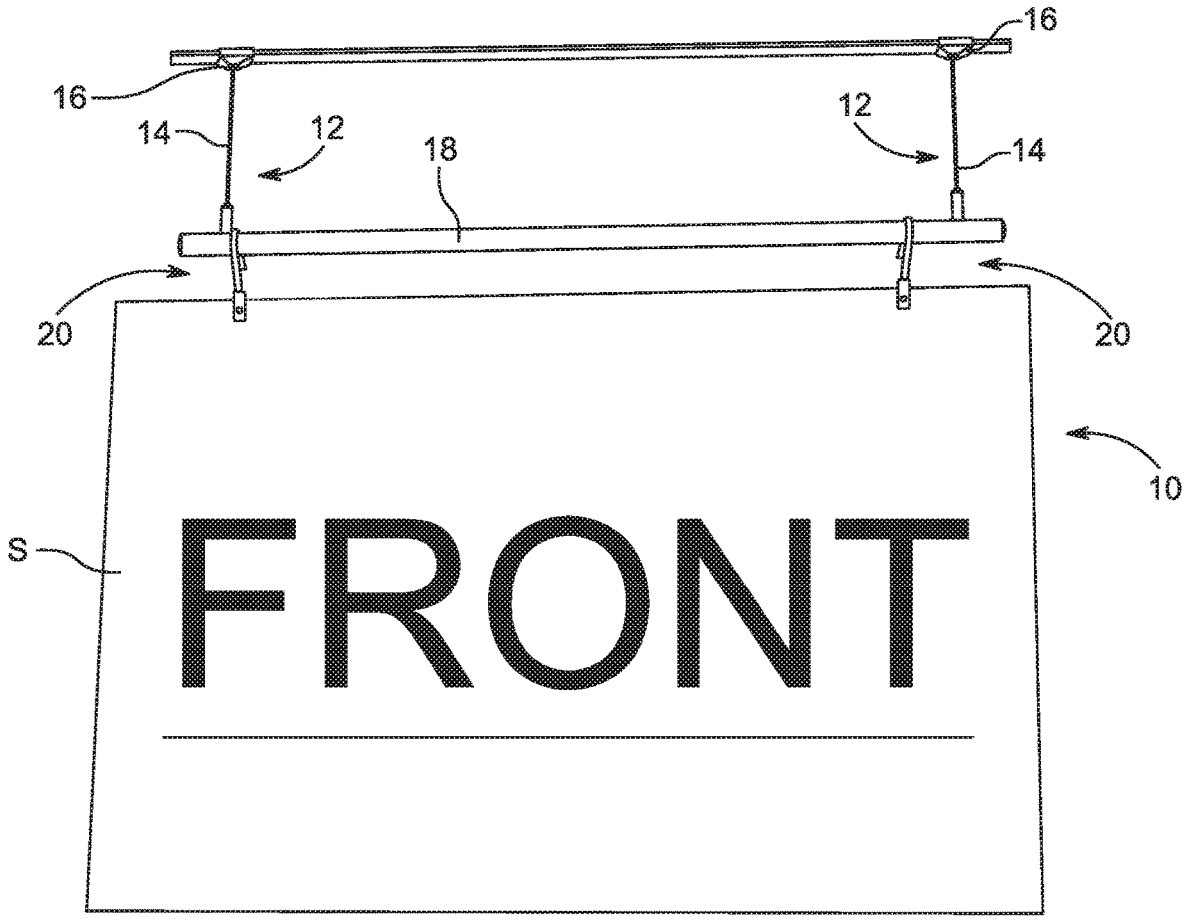
FIG. 1: is a front view of a sign suspension system according to a first embodiment of the invention.
Figure 2:
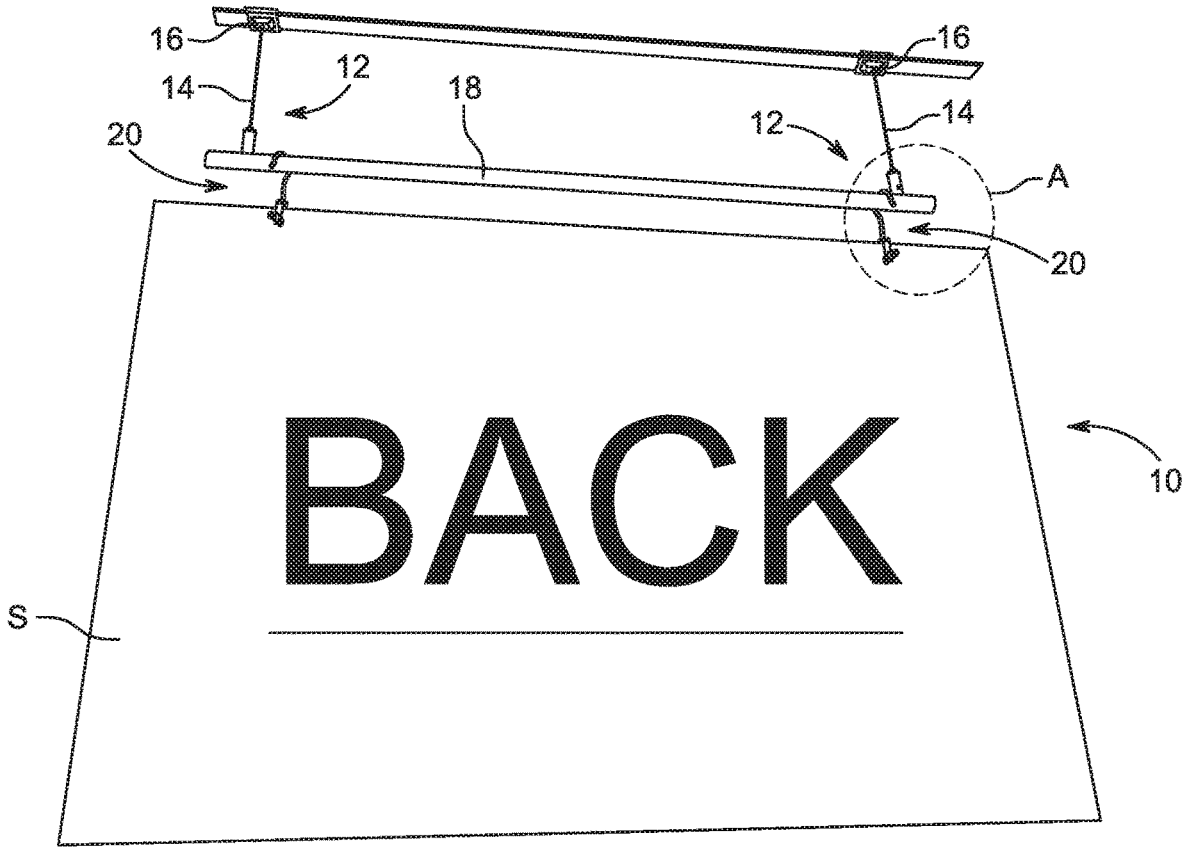
FIG. 2: is a rear view of the sign suspension system of FIG. 1.
Figure 3:
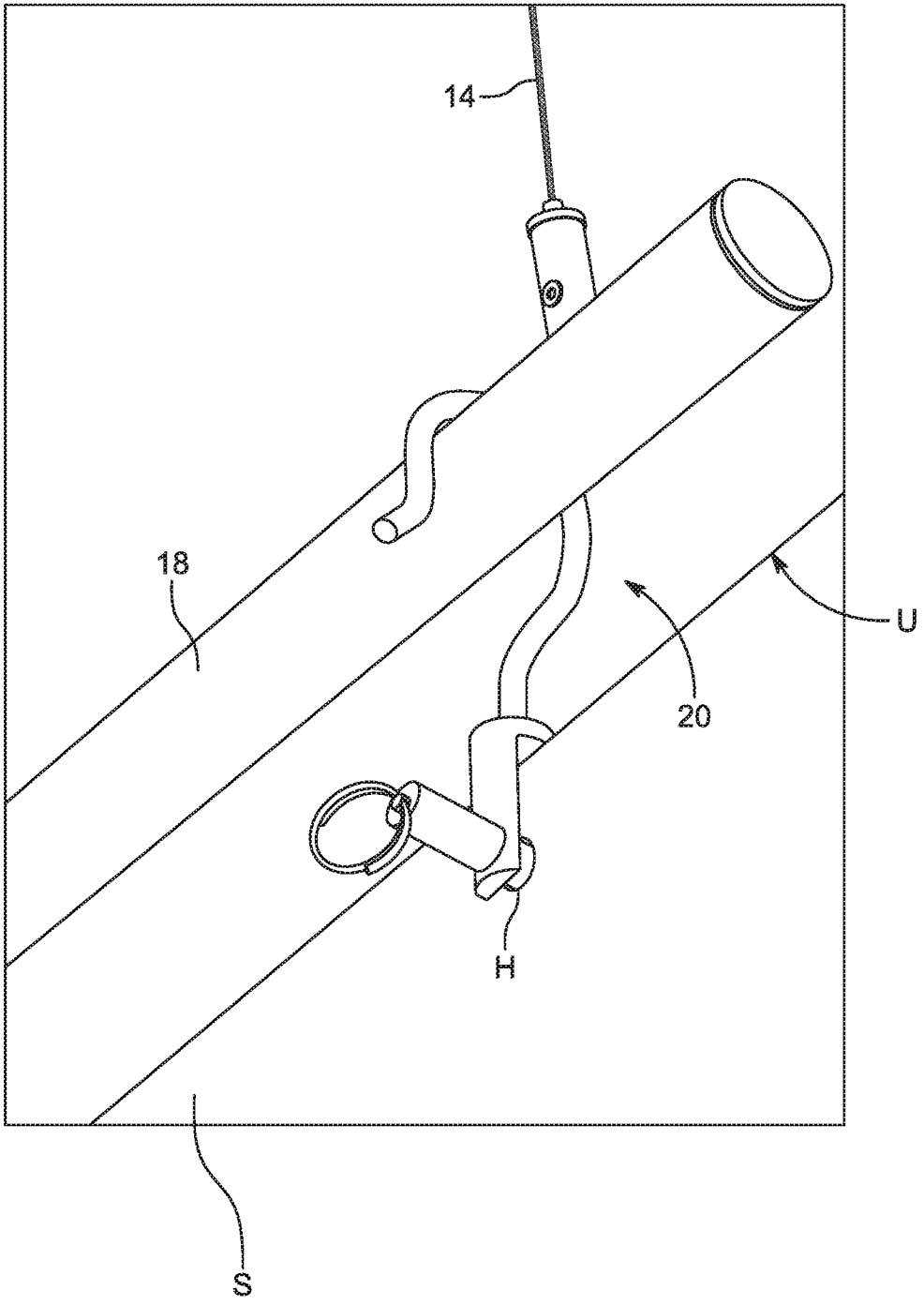
FIG. 3: is an enlarged view of region A in FIG. 2.

FIGS. 1 to 3 show a system 10 for hanging a piece of sheet material, such as a poster S. The system 10 includes droppers 12 that each have a tensile member 14, and an upper end connector 16. The upper end connectors 16 connect the upper ends of the tensile member 14 to a soffit or soffit-like structure. In the example of FIGS. 1 to 3, the soffit-like structure is part of a suspended ceiling. In particular, the upper end connectors 16 are the frame structure of the suspended ceiling, and support ceiling tiles. In this example, the system 10 has two droppers 12.

The system 10 also includes a rail 18 that is secured to the lower ends of the tensile members 14. When the system is installed, the rail 18 is suspended beneath the soffit-like structure. Ideally, the system is arranged with the rail 18 in a generally horizontal position.

The system 10 also has devices 20 that, in use of the system 10, hang a piece of sheet material. To this end, the poster S may be retained to the devices 20, so as to suspend the poster S above the ground. In this particular example, the system 10 has two devices 20. However, it will be appreciated that in other instances of the system there may be three or more devices.

One of the two devices 20 is shown in FIGS. 3 to 9 in further detail. FIG. 3 shows the device 20 in situ, with the poster S retained to the device 20, and the device 20 hooked onto the rail 18. The manner in which a piece of sheet material is retained to the device 20, and also the manner in which the device 20 is hooked onto the rail 18 will be evident from the following description with reference to FIGS. 4 to 8. For simplicity, the following description will refer to a single device 20, but, at least in this particular embodiment, the features of the two devices 20 are identical.

The device 20 has a body member 22, a catch member, and a hook 24. In this embodiment, the body member 22 has a crown portion 26, and pair of spaced apart legs 28 that extend from the crown portion 26. A slot 30 is defined between the legs 28. Further, the slot 30 opens at a bottom end of the body member 22. Accordingly, the body member 22 is able to locate on an edge of the poster S, with a portion of the poster S positioned within the slot 30. In other words, the two legs 28 are on opposing sides of the part of the poster S that is located within the slot 30.

The catch member co-operates with the body member 22 to retain the poster S to the body member 22. In this embodiment, the catch member is movable between an engaged position in which the catch member resists removal of the poster S that is positioned within the slot 30 thereby retaining the poster S to the body member 22, and a retracted position in which the poster S may be removed from the slot 30.

In embodiment of FIGS. 3 to 9, the catch member is in the form of a pin 32, and a first one of the legs 28*a* has a through hole 34. The pin 32 extends through the through hole 34 and projects transversely with respect to the slot 30.

The pin 32 is movable between an engaged position, and a retracted position. When the pin 32 is in the engaged position, the pin 32 resists removal of the poster S that is positioned within the slot 30. When the pin 32 is in the retracted position, the poster S is removable from the slot 30. As shown in FIG. 3, the poster S has a hole H that is located adjacent the upper edge U. In this embodiment, when in the engaged position, the pin 32 extends through the hole H, thus blocking (or at least inhibiting) removal of the poster S from the slot 30. When the pin 32 is in the retracted position and poster S is positioned in the slot 30, the pin 32 is sufficiently spaced from the poster S to allow removal of the poster S from the slot 30.

Figure 5:
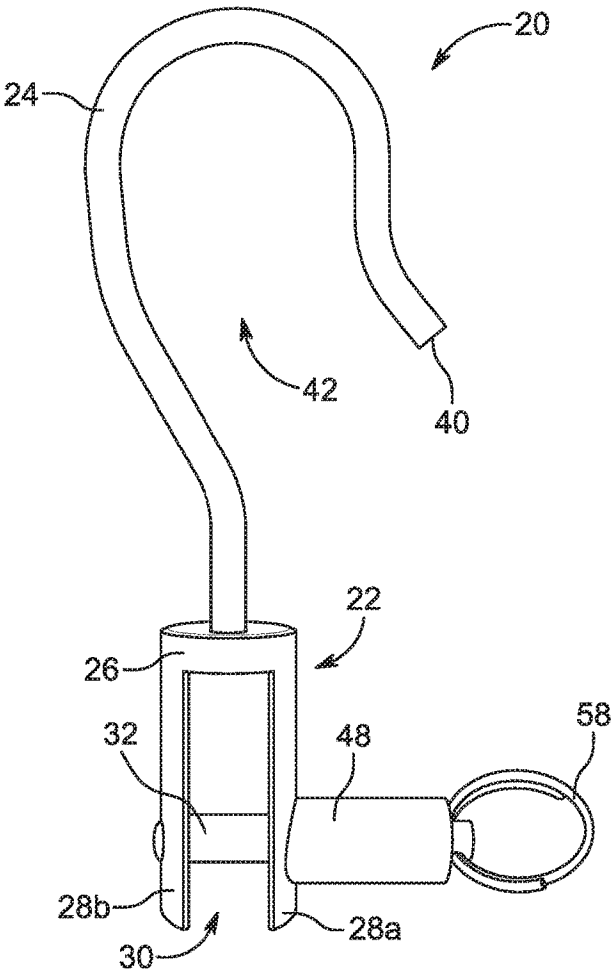
FIG. 5: is a right side view of a device of the sign suspension system of FIG. 1.
Figure 4:
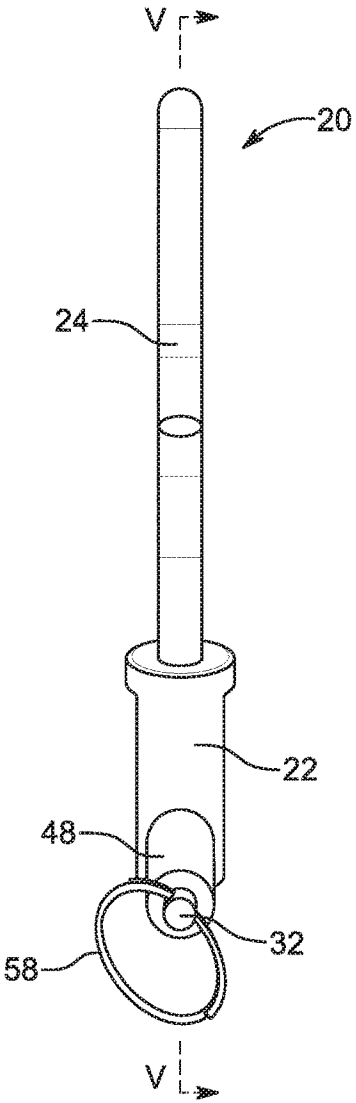
FIG. 4: is a rear view of a device of the sign suspension system of FIG. 1.
Figure 6:
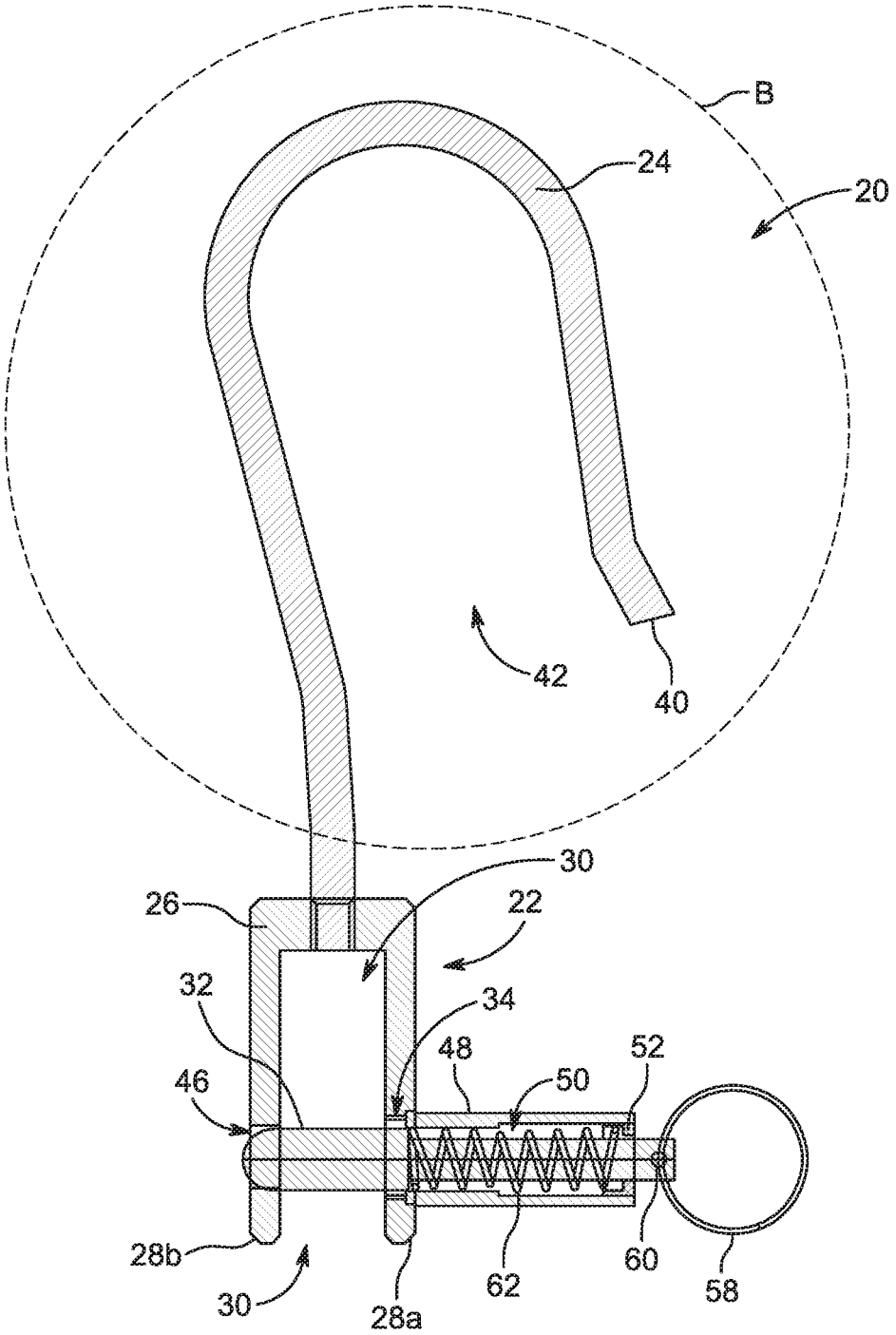
FIG. 6: is a schematic vertical cross section of the device, as viewed along the line V-V in FIG. 4, showing the retaining pin in an engaged position.
Figure 7:
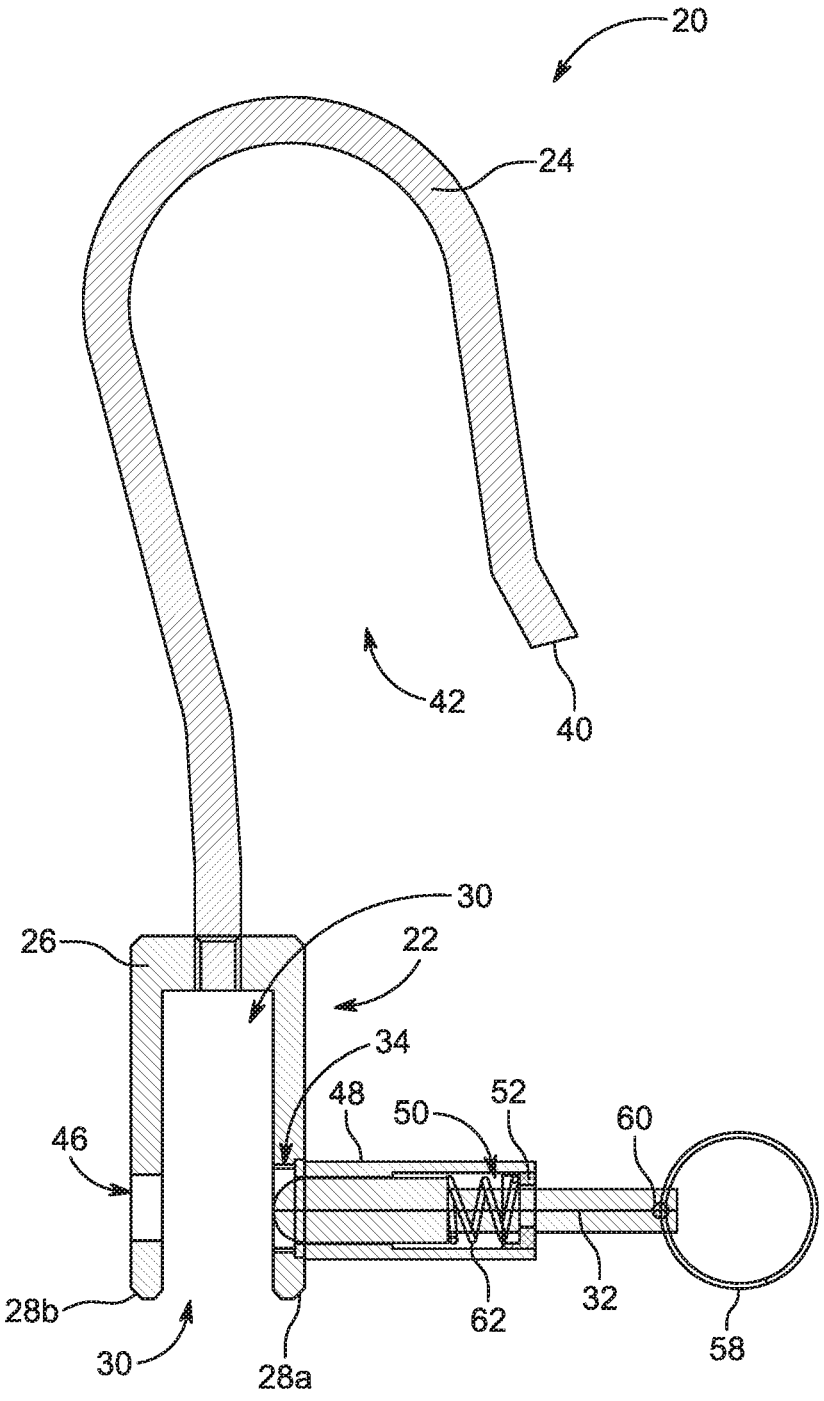
FIG. 7: is a schematic vertical cross section of the device, as viewed along the line V-V in FIG. 4, showing the retaining pin in a retracted position.

FIGS. 5 and 6 show the pin 32 in an engaged position, and FIG. 7 shows the pin 32 in a retracted position. It will be appreciated that there may be a number of alternative engaged positions in which the relative position of the pin 32 and body member 22 is such that removal of the poster S from the slot 30 is resisted. Similarly, it will be appreciated that there may be a number of alternative retracted positions in which the relative position of the pin 32 and body member 22 is such that the poster S is removable from the slot 30.

Figure 8:
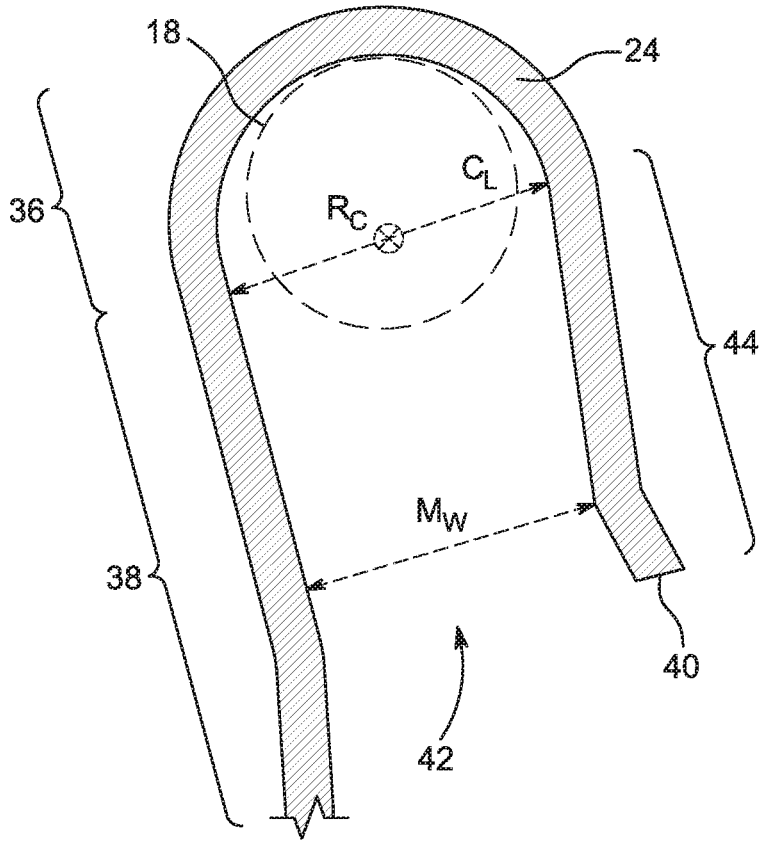
FIG. 8: is an enlarged view of region B in FIG. 6.

As shown in detail in FIG. 8, the hook 24 that includes a bight portion 36, and a shank portion 38. The hook 24 is connected to the body member 22 at a lower end of the shank portion 38. At one side of the bight portion 36 is the shank portion 38. The hook 24 also has a point end 40 that is spaced from the shank portion 38 by the bight portion 36. Thus, the point end 40 is at the opposing second side of the bight portion 36 to the shank portion 38. The hook 24 defines an access gap 42 between the shank portion 38 and the point end 40. An article of suitable size, such as the rail 18, may be passed through the access gap 42, and located within the bight portion 36. In this way, the device 20 may hang from the article. In FIG. 8, the general position of the rail 18 (which is of circular cross section in this example), when the device 20 is hanging from the rail 18, is illustrated in dashed lines.

In this particular embodiment, the hook 24 is oriented with respect to the body member 22 such that the direction of movement of the pin 32 between the engaged and retracted positions is parallel with a plane defined by the bight portion 36 of the hook 24. In this particular embodiment, the device 10 is configured with the hook 24 oriented with respect to the body member 22 such that the direction of movement of the pin 32 from the retracted position towards the engaged position is opposite to the direction from the shank portion 38 towards the point end 40.

In this particular embodiment, the hook 24 also includes an end portion 44 that extends between the bight portion 36 and the point end 40. In this example, the shank portion 38, bight portion 36, and end portion 44 are contiguous. In other words, the shank portion 38, bight portion 36, and end portion 44 are formed as a single component.

The second leg 28*b* of the body member 22 includes a hole 46 that is axially aligned with the through hole 34 in the first leg 28*a*. When the pin 32 is in the engaged position illustrated in FIGS. 5 and 6, the pin 32 extends into the hole 46 in the second leg 28*b*. In this way, when in the engaged position, the pin 32—and the poster S—is supported by both legs 28 of the body member 22. In this particular embodiment, the hole 46 in the second leg 28*b* is a through hole. In the engaged position shown in FIGS. 5 and 6, the pin 32 extends through both through holes 34, 46.

The pin 32 and body member 22 are configured so that the pin 32 is retained within the body member 22 in the retracted position. To this end, in this embodiment, the body member 22 includes a housing 48 that projects from the first leg 28*a*, and the housing 48 has an internal bore 50 that aligns with the through hole 34 in the first leg 28*a*. The pin 32 is captured within the housing 48. Consequently, the pin 32 extends through the internal bore 48 when in the engaged position, and at least a portion of the pin 32 extends into the internal bore 48 when in the retracted position.

The housing 48 includes an annular flange 52 that is spaced from the first leg 28*a*. The opening of the annular flange 52 is aligned with the through hole 34. Further, the through hole 34 and opening of the annular flange 52 are at opposing ends of the internal bore 50.

Figure 9:
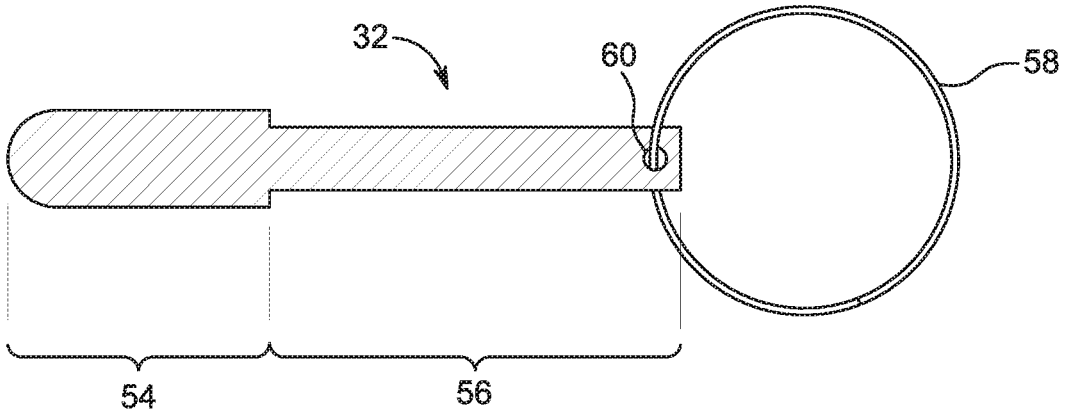
FIG. 9: is a side view of the pin of the device of FIG. 1.

As shown in FIG. 9, the pin 32 has a leading portion 54 and a trailing portion 56. In the device 20, the leading portion 54 is closer to the second leg 28*b* than the trailing portion 56. The outer diameter of the trailing portion 56 is less than the outer diameter of the leading portion 54, such that there is an annular shoulder formed between the leading and trailing portions 54, 56. There is a clearance fit between the inner diameter of the annular flange 52 and the outer diameter of the trailing portion 56. There is also a clearance fit between the diameter of the through hole 34 and the largest diameter of the leading portion 54. However, the inner diameter of the annular flange 52 is less than the outer diameter of the leading portion 54. In this way, the leading portion 54 of the pin 32 is able to move into the internal bore 50, but is not able to pass through the annular flange 52.

The pin 32 includes a ring 58 that extends through a transverse hole 60 at the rear of the trailing portion 56. The ring 58 is unable to pass through the annular flange 52 into the housing 48. Accordingly, the pin 32 is captured within the housing 48. The ring 58 also forms a clasping feature—in other words, a handle—with which a user may grasp for moving the pin 32, for example from the engaged position to the retracted position.

The device 20 further has a spring 62 that biases the pin 32 towards the engaged position. The spring 62 is a coil spring that, in this embodiment extends around the trailing portion 56 of the pin 32. The spring 62 has an inner diameter that is less than the outer diameter of the leading portion 54. Further, the inner diameter of the annular flange 50 is less than the outer diameter of the spring 62. In this way, the spring 62 is captured within the housing 48. In this embodiment, the spring 62 has a natural length that corresponds with the internal bore 50 of the housing 48. When the spring 62 is in its relaxed state, the pin 32 is in an engaged position. Movement of the pin 32 from the engaged position towards a fully retracted position causes the spring 62 to be compressed between the annular shoulder of the pin 32, and the annular flange 52 of the housing 48.

As shown particularly in FIG. 9, a section of the leading 54 portion that is remote from the trailing portion 56 tapers in a direction away from the trailing portion 56. This taper facilitates the pin 32 moving into the hole 46 in the second leg 28*b*, should there be some misalignment between the longitudinal axes of the hole 46 and the pin 32. In this particular embodiment, the pin 32 has a domed nose.

As shown in FIGS. 5 to 7, the hook 24 is oriented with respect to the body member 22 such that the direction across the bight portion 36 and away from the shank portion 38 is generally perpendicular to the planar direction that a poster S takes when located within the slot 30. In this embodiment, the bottom end of the shank portion 38 has an external thread, and the crown portion 26 has an internally threaded hole. If desired, a thread locking adhesive or the like may be used to maintain the desired relative orientation of the body member 22 and hook 24.

As is evident from FIGS. 5 to 7, the shank portion 38 of this embodiment includes a bend in an opposing direction to that of the bight portion 36. The shank portion 38 also has bend in the same direction as that of the bight portion 36. This shape encourages the device 20 to hang on the rail 18 in an orientation in which the slot 30 is substantially vertical. This minimizes the propensity of the device 20 to apply horizontal pressure to the poster S from the body member 22, when hanging from the rail 18. As will be appreciated, any such horizontal pressure will introduce creases or folds in the poster S, which may detract from the aesthetic of the poster S.

In this particular embodiment, the bight portion 36 is generally arcuate, and has a substantially constant radius. In FIG. 8, the radial centre of the bight portion is indicated by encircled cross hairs $R_C$. Further, a chord line $C_L$ that extends between opposing ends of the bight portion 36 is indicated by a dashed line with double headed arrows. The bight portion 36 is configured such that the radial centre $R_C$ is located on the chord line $C_L$. In some alternative embodiments, the radial centre $R_C$ is located between the bight portion 36 itself, and the chord line $C_L$. In such embodiments, the bight portion 36 circumscribes at least a half circle.

In FIG. 8, the minimum width $M_W$ of the enclosed region of the hook 24, which is between the access gap 42 and the deepest portion of the bight portion 36, is indicated by dashed line with double headed arrows. This minimum width $M_W$ is less than the length of the chord line $C_L$, described above. In this embodiment, the end portion 44 includes a bend in an opposing direction to that of the bight portion 36. In this way, the minimum width $M_W$ of the enclosed region of the hook 24 is spaced from the point end 40. Accordingly, the geometry of the hook 24 is such that, once the rail 18 is between the minimum width $M_W$ of the enclosed region of the hook 24 and the bight portion 36, the likelihood of the hook 24 to lift or fall off the rail 18 is reduced.

In use of the system 10, the droppers 12 and rail 18 are assembled, with the upper end connectors 16 connected to the soffit-like structure. Devices 20 are then attached to a poster S at appropriate locations along the upper edge U. As will be appreciated, with holes H pre-formed in the poster S, each device 20 is attached to the poster S by moving the pin 32 into the retracted position, positioning the poster S in the slot 30 with the hole H aligned with the pin 32, and then releasing the pin 32 to assume an engaged position. In some alternative scenarios, in which the poster S does not have pre-formed holes, the pin 32 may be driven through the poster material to create the holes, whilst moving the pin 32 from the retracted position to the engaged position. The poster S and devices 20 are then ready to be hung from the rail 18.

In some instances, the poster S may be formed of a sufficiently stiff material that enables the poster S to be lifted from lower regions without bending. This may be beneficial in minimizing the height above the ground surface to which a user must reach in order to locate the hooks 24 on the rail 18.

Figure 10:
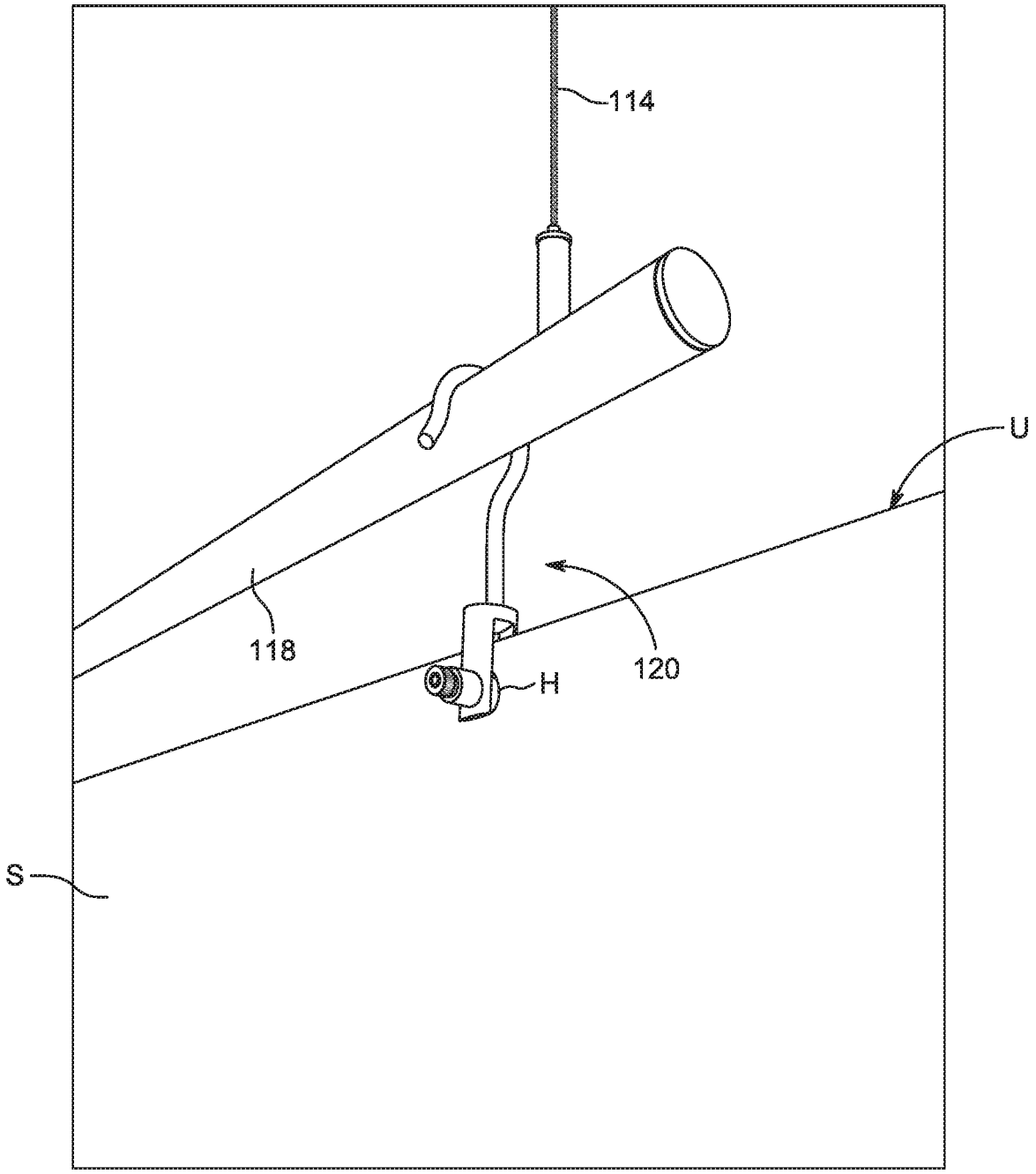
FIG. 10: is a partial rear view of a sign suspension system according to a second embodiment.

FIG. 10 shows a part of a device 120 of a system for hanging a piece of sheet material, such as a poster S. Parts of the device 120 that are the same or similar to parts of the device 20 have the same reference numbers with the prefix "1" and for succinctness, will not be described again. The device 120 is shown in further detail in FIGS. 11 to 16.

Figure 12:
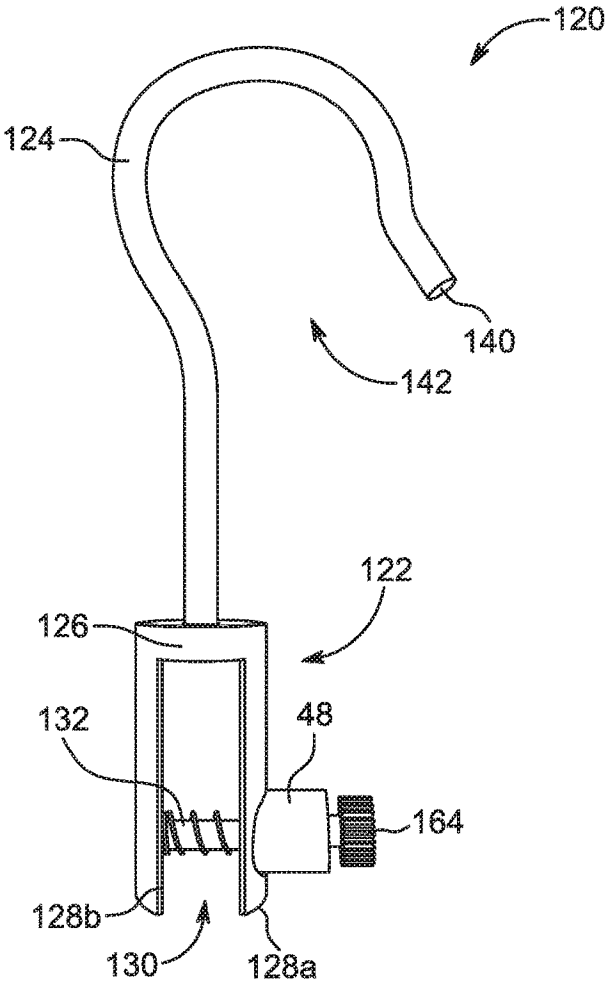
FIG. 12: is a right side view of a device of the sign suspension system of FIG. 10.
Figure 11:
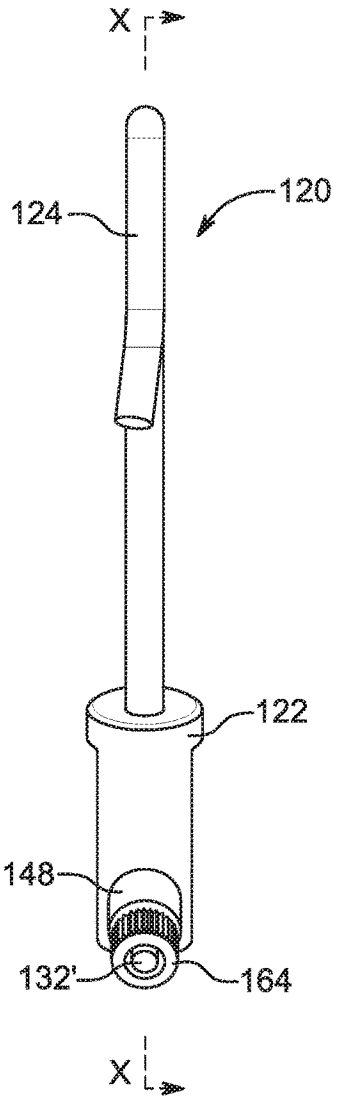
FIG. 11: is a rear view of a device of the sign suspension system of FIG. 10.
Figure 13:
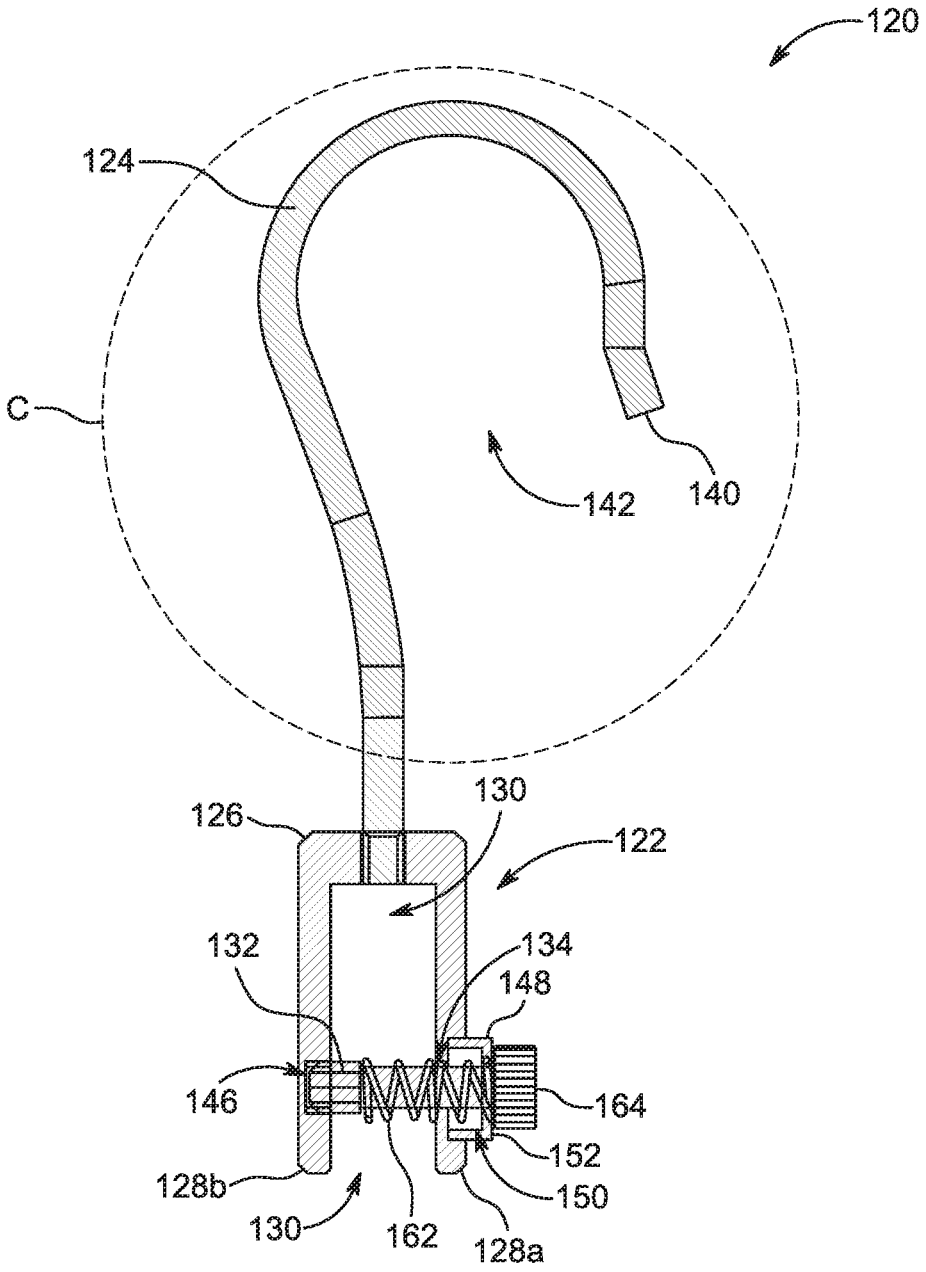
FIG. 13: is a schematic vertical cross section of the device, as viewed along the line X-X in FIG. 11, showing the retaining pin in an engaged position.
Figure 14:
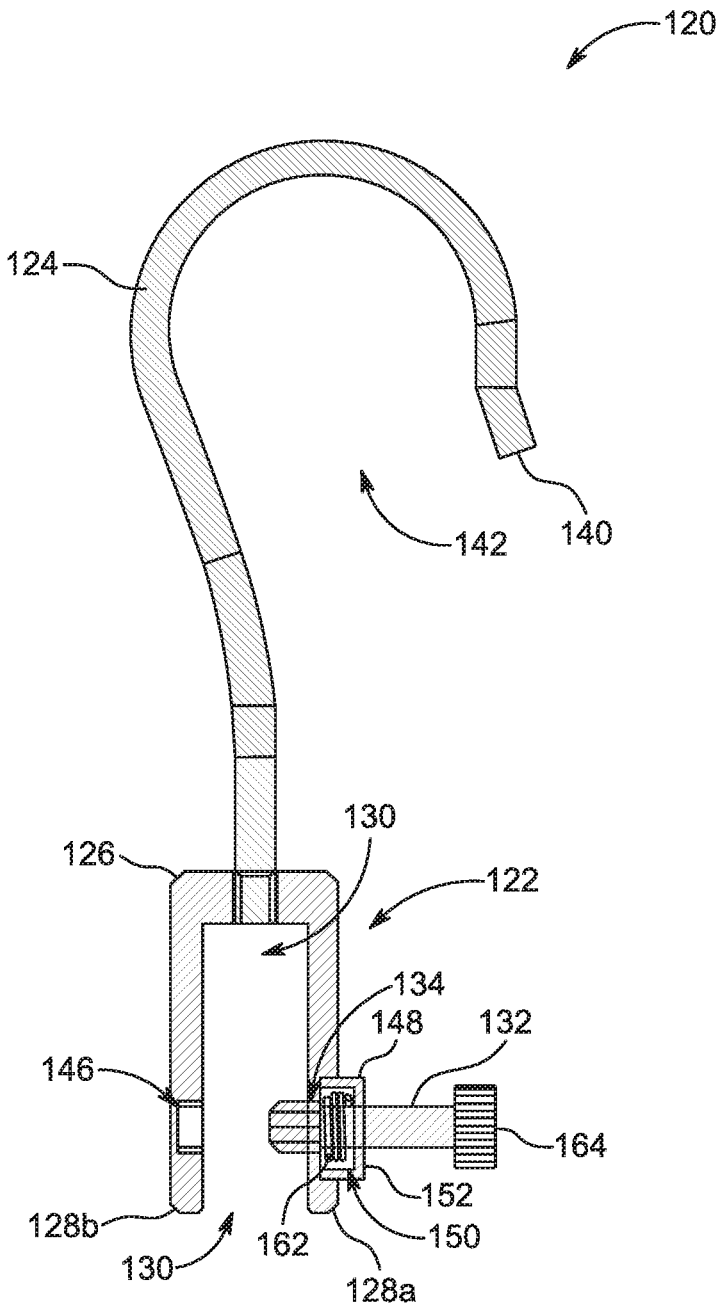
FIG. 14: is a schematic vertical cross section of the device, as viewed along the line X-X in FIG. 11, showing the retaining pin in a retracted position.
Figure 15:
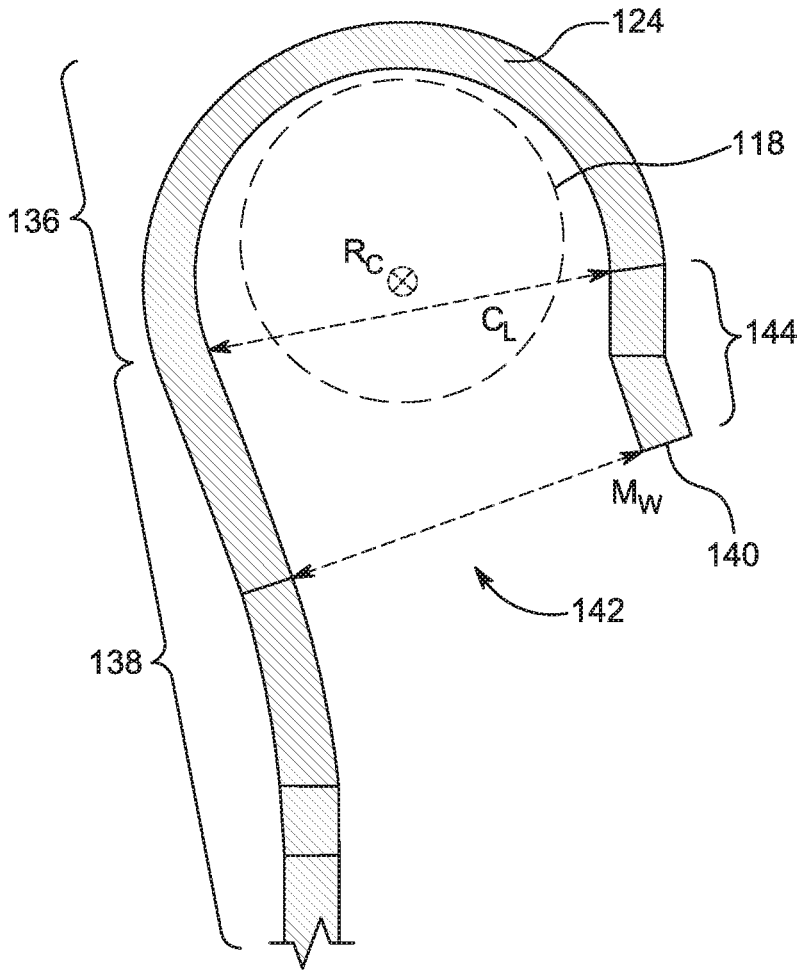
FIG. 15: is an enlarged view of region C in FIG. 13.

As will be apparent from FIGS. 12 to 14, the hook 124 has different geometries, but otherwise performs in a manner similar to hook 24.

Further differences reside in the body member and the catch member. In this embodiment, the catch member is also in the form of a pin 132. As with the device 20, the pin 132 co-operates with the body member 122 to retain the poster S to the body member 122. In addition, the pin 132 is movable between an engaged position in which the pin 132 resists removal of sheet material that is positioned within the slot 130 thereby retaining the poster S to the body member 122, and a retracted position in which the poster S may be removed from the slot 130.

In the embodiment of FIGS. 10 to 16, the body member 122 has a through hole 34 in a first one of the legs 128*a*. The pin 132 extends through the through hole 134 and projects transversely with respect to the slot 130. The second leg 128*b* of the body member 122 includes a hole 146 that is axially aligned with the through hole 134 in the first leg 128*a*. When the pin 132 is in the engaged position, illustrated in FIGS. 12 and 13, the pin 132 extends into the hole 146 in the second leg 128*b*.

In this embodiment, the hole 146 in the second leg 128*b* is a blind hole, such that when the pin 132 is in the engaged position the leading end 154 of the pin 132 is located within the blind hole 146.

Figure 16:
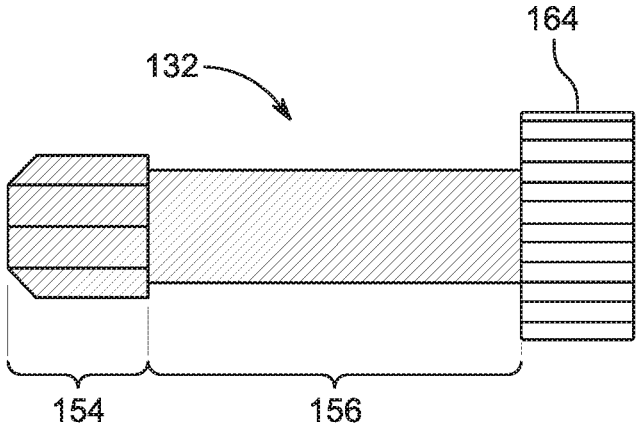
FIG. 16: is a side view of the pin of the device of FIG. 10.

The leading portion 154 of the pin 132 has at least one radial projection in the form of an external thread. The body member 122 has at least one complementary engagement feature, which in this embodiment is in the form of an internal thread in the hole 146 of the second leg 128*b*. The threads on the leading portion 154 and hole 146 interengage when the pin 132 is in the engaged position. As shown in FIG. 16, the pin 132 has a head 164 that is provided for use in rotating the pin 132 to bring the threads into and out of engagement.

The leading portion 154 being spaced from the head 164 by the trailing portion 156, which has a smooth cylindrical outer surface. The major diameter of the external thread on the leading portion 154 is greater than the diameter of the trailing portion 156. As is evident from FIGS. 13 and 14, a spring 162 extends around the trailing portion 156. The major diameter of the external thread on the leading portion 154 is greater than the diameter of the coil spring 162. Further, the diameter of the coil spring 162 is greater than the inner diameter of the annular flange 152 of the housing 148.

In this embodiment, the through hole 146 is dimensioned to allow the leading portion 154 of the pin 132 to move into the internal bore 150 of the housing 148. Thus, the coil spring 162 is also able to pass through the through hole 134. As will be evident from FIGS. 13 and 14, the coil spring 162 is captured between the annular flange 152 and the leading portion 154.

Figure 17:
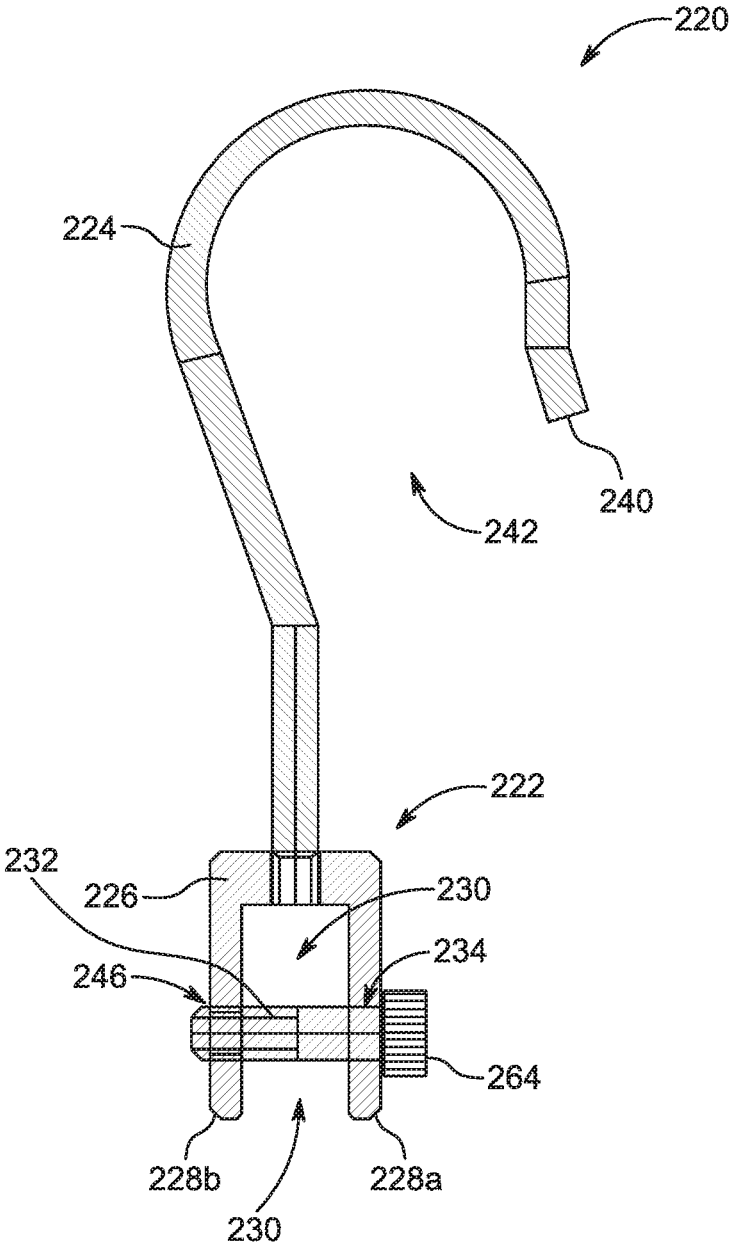
FIG. 17: is a schematic vertical cross section of a device of a third embodiment, showing the retaining pin in an engaged position.
Figure 18:
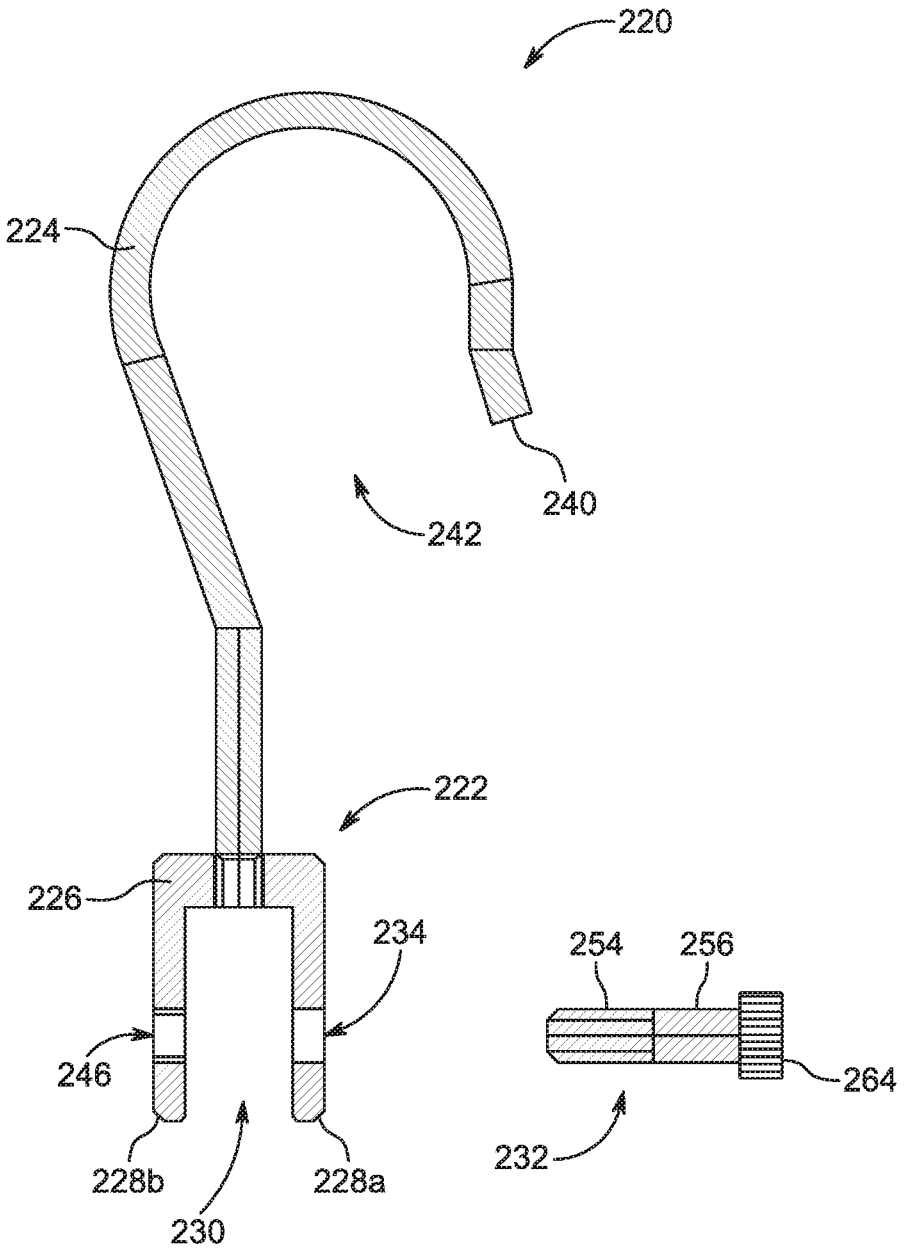
FIG. 18: is a schematic vertical cross section of the device of FIG. 17, showing the retaining pin in a retracted position.

FIGS. 17 and 18 show a device 220 of a third embodiment. Parts of the device 220 that are the same or similar to parts of the device 10 have the same reference numbers with the prefix "2" and for succinctness will not be described again.

The leading portion 254 of the pin 232 has at least one radial projection in the form of an external thread. The body member 222 has at least one complementary engagement feature, which in this embodiment is in the form of an internal thread in the hole 246 of the second leg 228*b*. The threads on the leading portion 254 and hole 246 interengage when the pin 232 is in the engaged position. As shown in FIG. 16, the pin 232 has a head 264 that is provided for use in rotating the pin 232 to bring the threads into and out of engagement.

The through hole 234 in the first leg 228*a* has a diameter that enables the leading and trailing portions 254, 256 to pass therethrough, as will be evident from FIGS. 17 and 18. Thus, once the threads on the leading portion 254 and hole 246 are out of engagement, the pin 232 is free to be withdrawn from the body member 222. In this way, in this embodiment the pin 232 is removable from the body member 222, and is not captive with respect to the body member 222. In contrast, the head 264 limits to the extent to which the pin 232 may extend first through the through hole 234, across the slot 230, and through hole 246.

Figure 19:
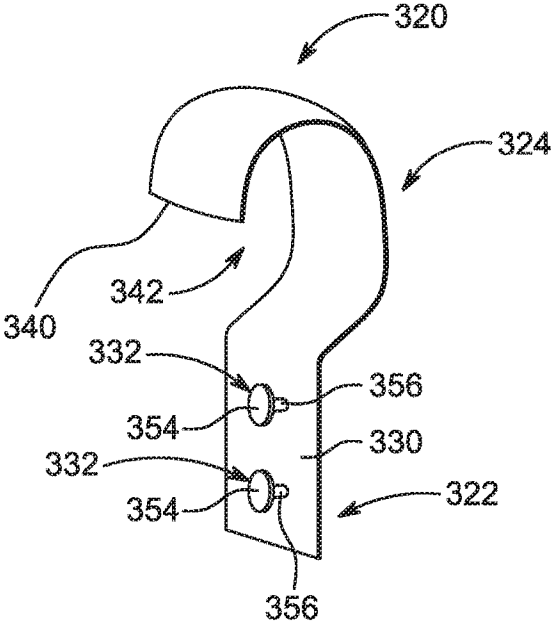
FIG. 19: is a schematic perspective view of a device of a fourth embodiment.

FIG. 19 shows schematically a device 320 for use in hanging a piece of sheet material. The device 320 has a body member 322 that includes a backing surface 330, and two catch pins 332. The device 320 also has a hook 324 with a point end 340.

The hook 324 is connected at its lower end to the body member 322 by a shank portion. The hook 324 also has a bight portion that is between the point end and the shank portion. An access gap 342 is provided between the shank portion and the point end 340. An article of suitable size, such as the rail 18 of the system shown in FIG. 1, may be passed through the access gap 342, and located within the bight portion. In this way, the device 320 may hang from the article.

Each catch pin 332 includes an inner portion 356 that is connected to the body member 322, and projects perpendicularly outwardly from the backing surface 330. In this embodiment, each catch pin 332 further includes an outer portion 354 that is spaced from the backing surface 330 by the inner portion 356. Each outer portion 354 includes a contact surface (not shown in FIG. 19) that extends generally transversely to the inner portion 356, and also faces towards the backing surface 330.

In use of the device 320, each of the catch pins 332 is passed through an aperture in the piece of sheet material. The sheet material is then captured between the backing surface 330 and the outer portions of the catch pins 332. In this way, the sheet material is retained to the device 320.

In some embodiments, the catch pins are resiliently deflectable from a neutral position. In some alternative embodiments, the catch pins are substantially rigid.

In this particular embodiment, each outer portion 354 is configured such that contact surface extends in two or more directions transversely with respect to the respective inner portion 356. More particularly, each outer portion 354 has a contact surface that is annular and generally radial with respect to the respective inner portion 356.

To retain the sheet material between the backing surface 330 and the outer portions of the catch pins 332, and inhibit dissociation of the sheet material and device 320, the sheet material has keyholes that are each for receiving a respective one of the catch pins 332. For the embodiment of FIG. 19, the sheet material must be pre-formed with a sets of two keyholes; examples of such sets are shown in FIGS. 20*a*, 20*b*, 20*c*.

Each keyhole is shaped to allow the outer portion 354 to pass through the keyhole in a first relative position of the device 320 and sheet material, and to inhibit the outer portion 354 passing through the keyhole in a second relative position of the device 320 and sheet material. The relative movement of the device 320 with respect to the sheet material between the first and second relative positions for each of the examples shown in FIGS. 20*a*, 20*b*, 20*c* involves at least one of translation and rotation of the device 320.

Figure 20A:
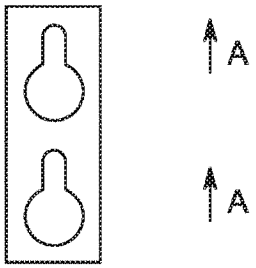
FIGS. 20*a* to 20*c*: are schematic views of aperture sets formed in sheet material for use in retaining the sheet material the device of FIG. 19.
Figure 20B:
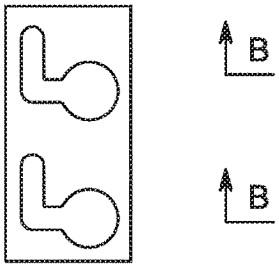
Figure 20C:
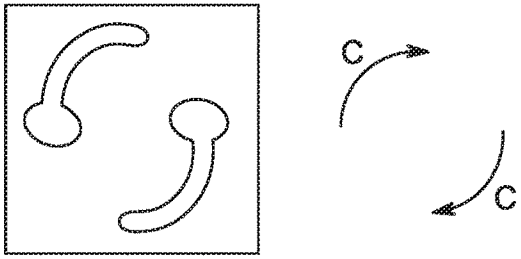

For each of the examples in FIGS. 20*a*, 20*b*, 20*c*, the relative movement is as follows:

for FIG. 20*a*: a translation in one direction, as indicated by arrows A;

for FIG. 20*b*: two sequential translations that are generally orthogonal to one another, as indicated by arrows B; and for FIG. 20*c*: a rotation, as indicated by arrows C.

Figure 21:
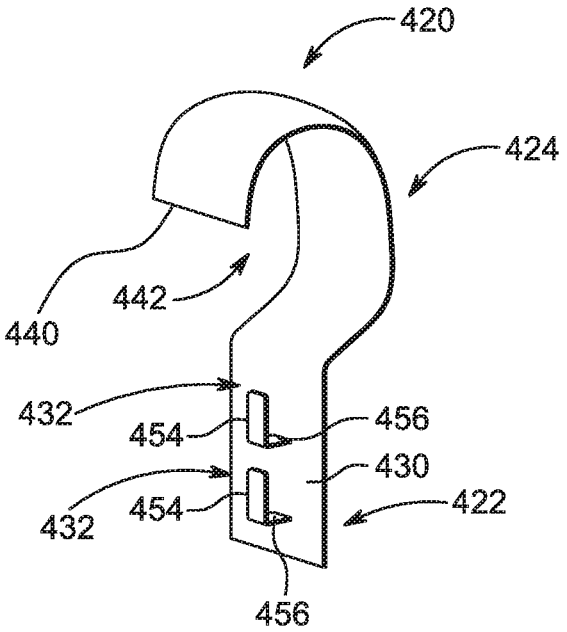
FIG. 21: is a schematic perspective view of a device of a fifth embodiment.

FIG. 21 shows schematically a device 420 for use in hanging a piece of sheet material. The device 420 is substantially similar to the device 320. Accordingly, parts of the device 420 that are the same or similar to parts of the device 320 have the same reference numbers, with the prefix "4" replacing the prefix "3".

Each catch pin 432 includes an outer portion 454 with a contact surface (not shown in FIG. 19) that extends generally transversely to the inner portion 456, and also faces towards the backing surface 430. The contact surface extends in only one direction from the inner portion 456. However, in this particular embodiment, the contact surface is inclined relative to the backing surface 430, such that the gap between the contact surface and the backing surface 430 narrows towards the respective inner portion 454.

Figure 22:
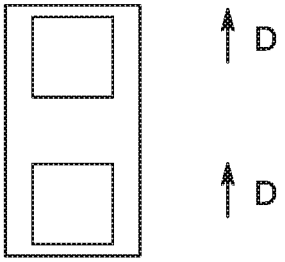
FIG. 22: is a schematic view of an aperture set formed in sheet material for use in retaining the sheet material to the device of FIG. 21.

To retain the sheet material between the backing surface 430 and the outer portions of the catch pins 432, the sheet material has keyholes that are each for receiving a respective one of the catch pins 432. For the embodiment of FIG. 21, the sheet material must be pre-formed with a sets of two keyholes; an examples of such sets are shown in FIG. 22.

Each keyhole is shaped to allow the outer portion 454 to pass through the keyhole in a first relative position of the device 420 and sheet material, and to inhibit the outer portion 454 passing through the keyhole is a second relative position of the device 420 and sheet material. The relative movement of the device 420 with respect to the sheet material between the first and second relative positions for the example shown in FIG. 22 involves a translation of the device 420, as indicated by arrows D.

With sheet material of appropriate thickness, the sheet material is compressed as the device 420 moves into the second relative position. To facilitate this compression, the catch pins 432 are resiliently deflectable from a neutral position. Friction between the sheet material, and each of the contact surfaces and backing surface 430 resists the device 430 from moving out of the second relative position.

Figure 23:
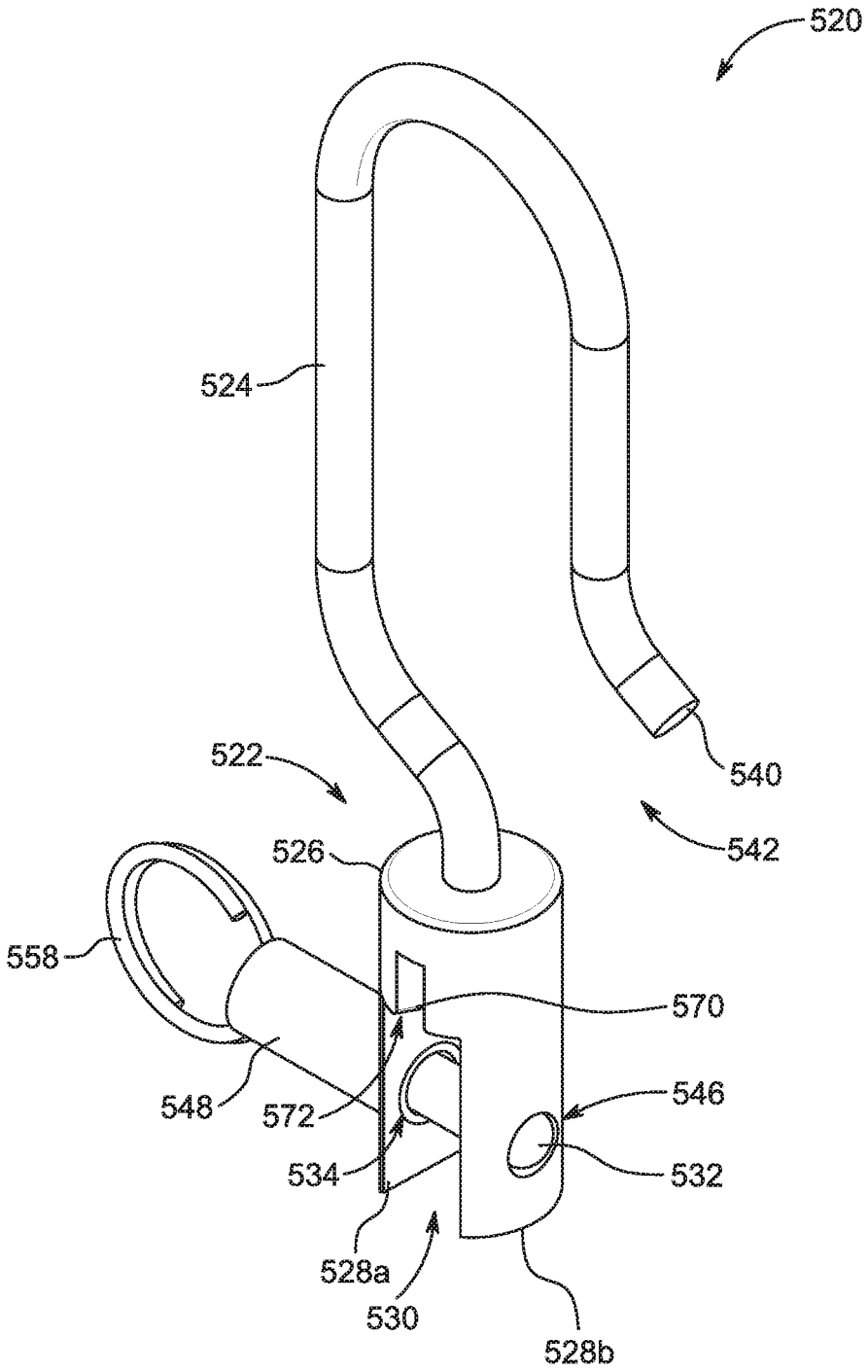
FIG. 23: is a schematic perspective view of a device of a fifth embodiment.
Figure 24:
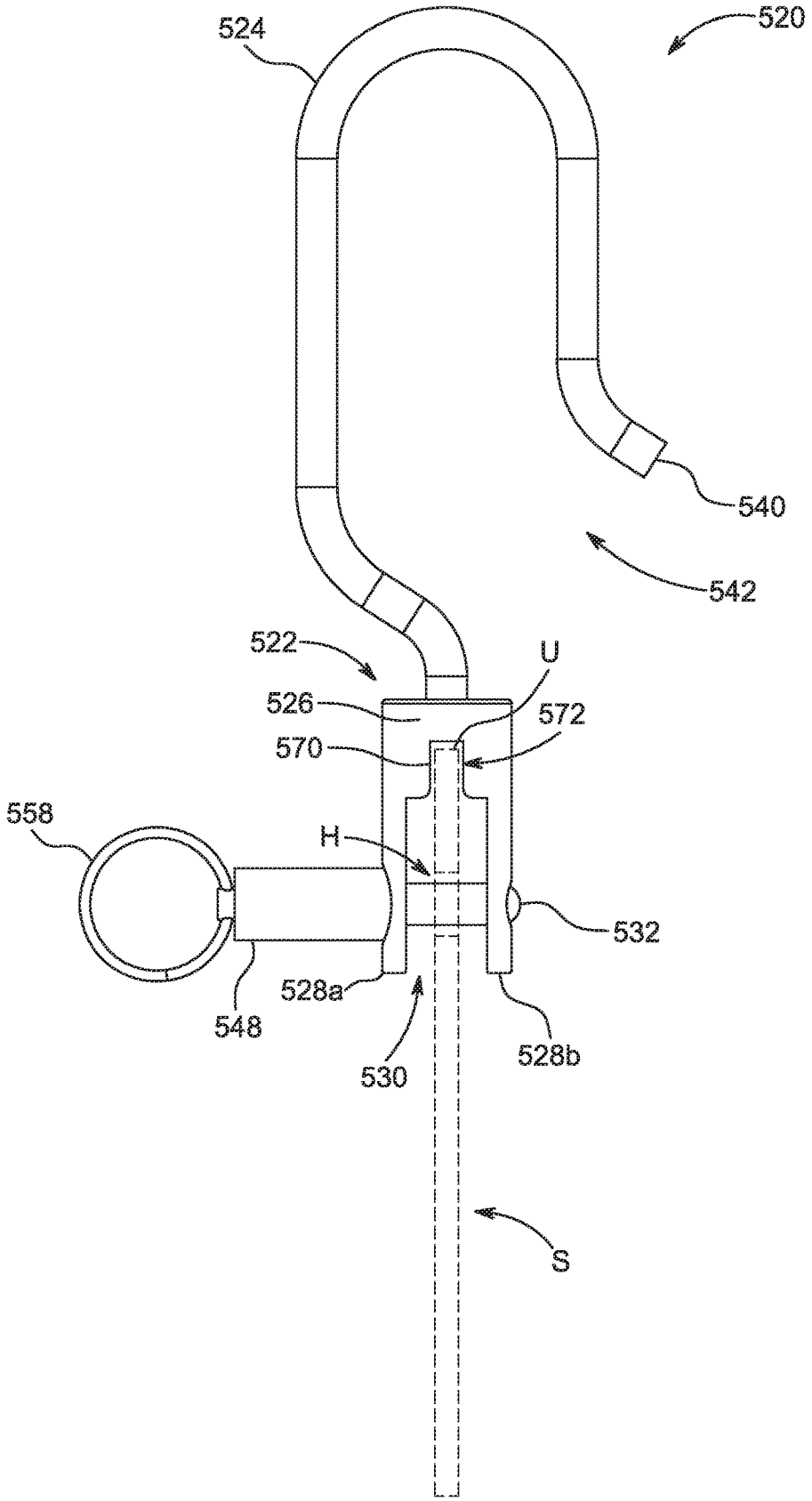
FIG. 24: is a schematic side view of the device of FIG. 23, shown with a piece of sheet material.

FIGS. 23 and 24 show a device 520 of a system for hanging a piece of sheet material, such as a poster S. Parts of the device 520 that are the same or similar to parts of the device 20 have the same reference numbers with the prefix "5" and for succinctness, will not be described again. In FIG. 24, the poster S is shown with the thickness direction extending in the plane of the view; in other words, the width direction of the poster S is normal to the plane of the view.

As shown most clearly in FIG. 24, the crown portion 526 of the body member 522 includes a channel 570 that defines a secondary slot 572. The secondary slot 572 opens onto the slot 530 defined between the legs 528. The width of the secondary slot 572 is narrower than that of the slot 530.

In instances in which the thickness of the poster S is less than the width of the secondary slot 572, the upper edge U of the poster S may be located within the secondary slot 572. In instances in which the poster S is formed of a sufficiently stiff material that the poster S may be lifted from lower regions without bending, having the upper edge U located within the secondary slot 572 has the benefit of minimizing the extent to which the device 520 may pivot on the intersection of the hole H and the pin 532. Alternatively or additionally, contact between the crown portion 526 around the channel 570 and the upper edge U of the poster S limits the rotation of the device 520 about the pin 532 and between the legs 528.

In this particular embodiment, secondary slot 572 is located centrally between the legs 528. In other words, the secondary slot 572 is spaced equidistant from the two legs 528.

At least one of the outer edges, and in this particular embodiment both outer edges of the channel 570 that are between the slot 530 and the secondary slot 572 are curved. This facilitates insertion of the upper edge U of the poster S into the secondary slot 572. In some alternative embodiments, at least one, and preferably both, of the outer edges of the channel 570 that are between the slot 530 and the secondary slot 572 are chamfered.

The housing 548 of the device 520 is located on the opposing side of the body portion 522 to the access gap 542. Further, in this particular embodiment, the hook 524 is oriented with respect to the body member 522 such that the direction of movement of the pin 532 between the engaged and retracted positions is parallel with a plane defined by the bight portion 536 of the hook 524. In this particular embodiment, the device 510 is configured with the hook 524 oriented with respect to the body member 522 such that the direction of movement of the pin 532 from the retracted position towards the engaged position is the same as the direction from the shank portion 538 towards the point end 540.

In some alternative embodiments, the hook may be oriented with respect to the body member such that the direction of movement of the pin between the engaged and retracted positions is oblique or transverse to the plane defined by the bight portion of the hook.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

What is claimed is:

1. A device for use in hanging sheet material, the device comprising:

a body member having a crown portion, and pair of spaced apart legs that extend from the crown portion and define a slot there between, the slot opening defined at a bottom end such that the body member is designed to locate on an edge of sheet material with a portion of sheet material positioned within the slot;

a catch member that is movable between an engaged position in which the catch member is capable of resisting removal of sheet material that is positioned within the slot thereby capable of retaining sheet material to the body member, and a retracted position in which the catch member is capable of being positioned such that sheet material is removable from the slot;

a hook that includes a bight portion, a shank portion that is attached at a lower end to the body member and at an upper end to one side of the bight portion, and a point end that is spaced from the shank portion by the bight portion at the opposing second side of the bight portion; and wherein the hook defines an access gap between the shank portion and the point end through which to pass an article to thereby locate the article within the bight portion so as hang the device from the article.

2. A device according to claim 1, wherein the crown portion includes a channel defining a secondary slot that opens onto the slot defined between the legs, wherein the width of the secondary slot is narrower than that of the slot.

3. A device according to claim 2, wherein the secondary slot is located centrally between the legs.

4. A device according to claim 2, wherein at least one of the outer edges that are between the slot and the secondary slot is convex.

5. A device according to claim 1, wherein the catch member is in the form of a pin, and a first one of the legs has a through hole, whereby the pin extends through the through hole and projects transversely with respect to the slot when in the engaged position.

6. A device according to claim 5, wherein the pin is completely withdrawn from the slot when in the retracted position.

7. A device according to claim 5, wherein the second leg includes a hole that is axially aligned with the through hole in the first leg, and whereby when the pin is in the engaged position the pin extends into the hole in the second leg.

8. A device according to claim 5, wherein the pin and body member are configured so that the pin is retained within the body member in the retracted position.

9. A device according to claim 5, wherein the body member includes a housing that projects from the first leg, the housing having an internal bore that aligns with the through hole in the first leg, wherein the pin extends through the internal bore when in the engaged position.

10. A device according to claim 9, wherein the housing includes an annular flange that is spaced from the first leg.

11. A device according to claim 5, wherein the pin includes a leading portion and a trailing portion, the leading portion being closer to the second leg than the trailing portion, and wherein the outer diameter of the trailing portion is less than the outer diameter of the leading portion.

12. A device according to claim 5, further comprising a spring that biases the pin towards the engaged position.

13. A device according to claim 12, wherein the inner diameter of the annular flange is less than the outer diameter of the spring, such that at least a portion of the spring is captured within the housing.

14. A device according to claim 11, wherein a section of the leading portion that is remote from the trailing portion tapers in a direction away from the trailing portion.

15. A device according to claim 11, wherein the leading portion is dimensioned such that when the pin is in the engaged position, one part of the leading portion is located within the hole in the second leg, and another part of the leading portion is located within the through hole in the first leg.

16. A device according to claim 11, wherein part of the trailing portion projects outwardly from the housing when the pin is in the engaged position.

17. A device according to claim 1, wherein the hook is oriented with respect to the body member such that the direction across the bight portion and away from the shank portion is designed to be oriented substantially perpendicular to the planar direction of sheet material located within the slot.

18. A device according to claim 1, wherein the bight portion is configured such that the radial centre of the bight portion is positioned on or between the bight portion and a chord line that extends between opposing ends of the bight portion.

19. A system for hanging a piece of sheet material, the system comprising:

a plurality of droppers that each have a tensile member, and an upper end connector for use in connecting the upper end of the respective tensile member to a soffit or soffit-like structure, the tensile member having a lower end;

a rail that is secured to the lower ends of the tensile members so as to be suspended beneath the soffit or soffit-like structure;

a plurality of devices, each of which comprise:

a body member having a crown portion, and pair of spaced apart legs that extend from the crown portion and define a slot there between, the slot opening defined at a bottom end such that the body member is designed to locate on an edge of sheet material with a portion of sheet material positioned within the slot;

a catch member that is movable between an engaged position in which the catch member is capable of resisting removal of sheet material that is positioned within the slot thereby capable of retaining sheet material to the body member, and a retracted position in which the catch member is capable of being positioned such that sheet material is removable from the slot;

a hook that includes a bight portion, a shank portion that is attached at a lower end to the body member and at an upper end to one side of the bight portion, and a point end that is spaced from the shank portion by the bight portion at the opposing second side of the bight portion; and wherein the hook defines an access gap between the shank portion and the point end through which to pass an article to thereby locate the article within the bight portion so as hang the device from the article; and wherein the body members of the devices are designed to retain piece of sheet material, and in one assembled configuration, the hooks of the devices are hooked onto the rail such that the rail is located within the bight portions of the devices to thereby designed to hang piece of sheet material.

20. A system according to claim 19, wherein each dropper includes a lower end connector at the lower end of the tensile member for connecting the lower end of the respective tensile member to the rail.

* * * * *